US005380214A

United States Patent [19]

Ortega, Jr.

[11] Patent Number: 5,380,214

[45] Date of Patent: Jan. 10, 1995

[54] PUSH-IN LIGHT SOCKET ADAPTER

[76] Inventor: Jerry Ortega, Jr., 28544 Ave. 15 ½, Madera, Calif. 93638

[21] Appl. No.: 106,518

[22] Filed: Aug. 16, 1993

[51] Int. Cl.[6] ..... H01R 31/06; H01R 33/22

[52] U.S. Cl. ..... 439/253; 439/490; 439/645; 439/802; 439/667; 439/735

[58] Field of Search ..... 439/123, 124, 253–257, 439/488–490, 628, 662–667, 734, 735, 753, 802, 642, 645

[56] References Cited

U.S. PATENT DOCUMENTS

| | | | |
|---|---|---|---|
| 2,191,336 | 2/1940 | Carroll | 439/257 |
| 2,503,677 | 4/1950 | McHenry et al. | 439/490 |
| 5,171,292 | 12/1992 | Ortiz | 435/253 |

FOREIGN PATENT DOCUMENTS

| | | | |
|---|---|---|---|
| 717199 | 8/1965 | Canada | 439/253 |
| 54-42877 | 4/1979 | Japan | 439/257 |
| 668104 | 3/1952 | United Kingdom | 439/257 |

*Primary Examiner*—Steven C. Bishop
*Attorney, Agent, or Firm*—Hugh E. Smith

[57] ABSTRACT

A push-in light socket adapter for use with a conventional household light bulb socket for facilitating a rapid removal and replacement of a light bulb. The adapter includes a threaded socket body which may be engaged to the household light bulb socket in place of the light bulb. The light bulb may then be inserted directly into the adapter without rotating the bulb. The adapter allows a removal of a burnt-out light bulb by a simple pulling motion which releases the bulb from the socket body. A new bulb may then be easily inserted into the adapter by pushing it into the socket body. The light socket adapter further includes an indicator light operable to indicate both a supply of electrical power to the device and a presence of the light bulb within the socket body.

1 Claim, 3 Drawing Sheets

FIG. 3
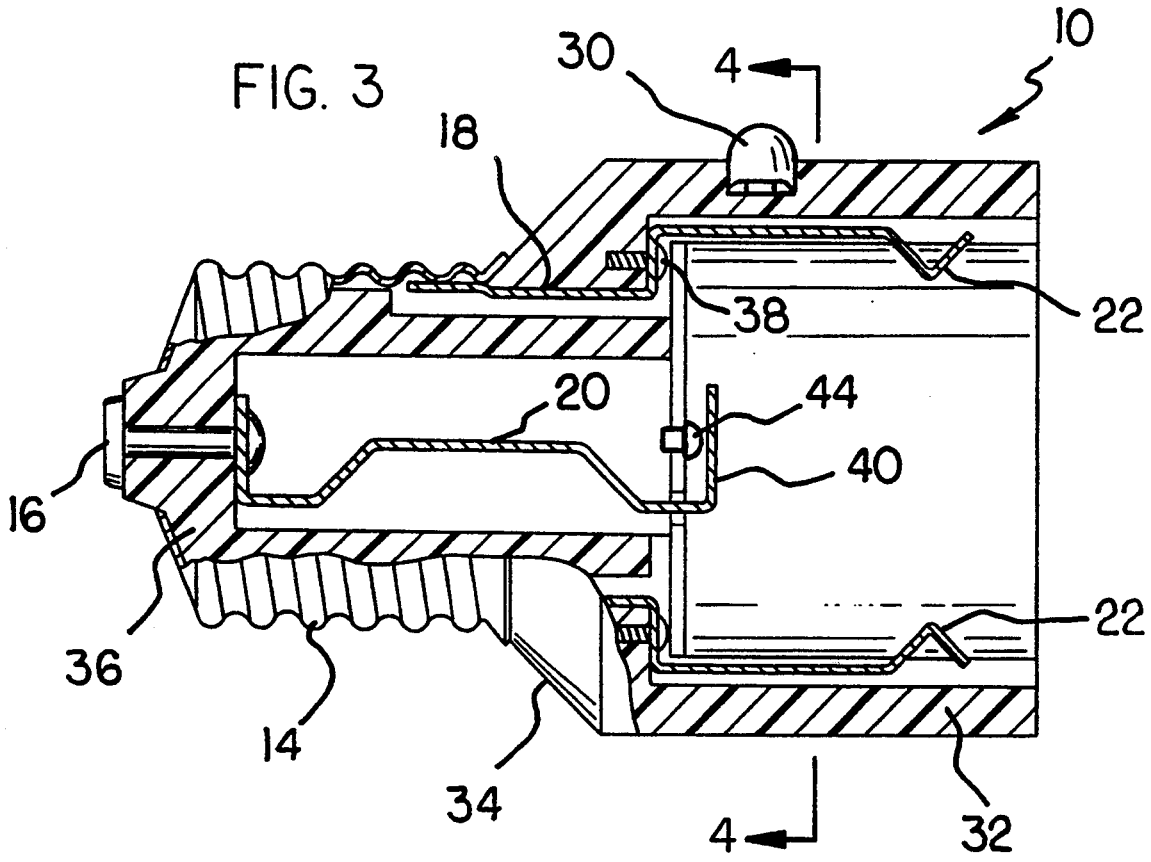
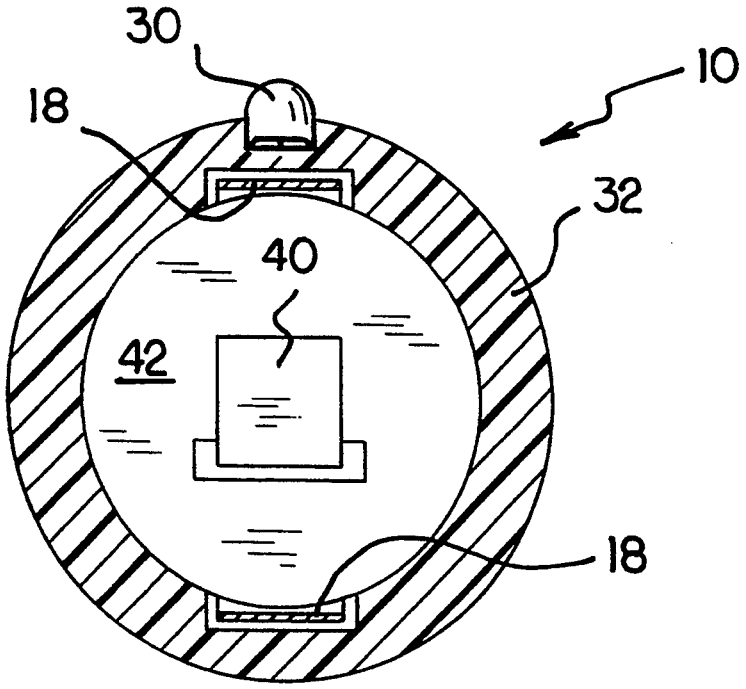
FIG. 4

PUSH-IN LIGHT SOCKET ADAPTER

BACKGROUND OF THE INVENTION

1. Field of the Invention

The present invention relates to light sockets and more particularly pertains to a push-in light socket adapter which may be utilized for facilitating a rapid removal and replacement of a light bulb.

2. Description of the Prior Art

The use of light sockets is known in the prior art. More specifically, light sockets heretofore devised and utilized for the purpose of retaining a light bulb and supplying electrical power thereto are known to consist basically of familiar, expected and obvious structural configurations, notwithstanding the myriad of designs encompassed by the crowded prior art which have been developed for the fulfillment of countless objectives and requirements.

For example, a push-in type of light socket is illustrated in U.S. Pat. No. 3,504,329 which utilizes a lamp socket for holding a light bulb with a conductive base in which the socket is made of plastic material and formed with unitary deformable bulb holding means on the inner wall of the socket. Electrical contact means are also provided in the socket to make electrical contact with the conductive base.

An elastic socket for light bulbs and fuses is described in U.S. Pat. No. 4,915,667 which employs a socket for light bulbs and fuses that has a metallic cylinder bulb or fuse receptacle having a longitudinal opening extending from its opening end across the opposed edges of which the opposed free ends of a coil spring are attached to frictionally engage a bulb or fuse entered into the receptacle cylinder with the coil spring.

Another patent of interest is U.S. Pat. No. 4,875,866 which discloses a light bulb socket for use with light bulbs of conventional design and threaded base that has a frame and a cup adapted to accept the light bulb base mounted for longitudinal motion within the frame between a first extended position and a second retracted position. An engagement finger engages the bulb thread when the cup is in the retracted position to retain the bulb in the cup, and releases the bulb when the cup returns to the extended position.

While these devices fulfill their respective, particular objectives and requirements, the aforementioned patents do not describe a light socket adapter for use with a conventional household light bulb socket for facilitating a rapid removal and replacement of a light bulb. Furthermore, the prior art does not teach a light socket adapter which includes an indicator light operable to indicate both a supply of electrical power to the device and a presence of a light bulb within the adapter. In these respects, the push-in light socket adapter according to the present invention substantially departs from the conventional concepts and designs of the prior art, and in so doing provides an apparatus primarily developed for the purpose of facilitating a rapid removal and replacement of a light bulb and indicating a supply of electrical power to the light bulb.

SUMMARY OF THE INVENTION

In view of the foregoing disadvantages inherent in the known types of light sockets now present in the prior art, the present invention provides a new push-in light socket adapter construction wherein the same can be utilized for facilitating a rapid removal and replacement of a light bulb and indicating a supply of electrical power to the light bulb. As such, the general purpose of the present invention, which will be described subsequently in greater detail, is to provide a new push-in light socket adapter apparatus which has many of the advantages of the light sockets mentioned heretofore and many novel features that result in a push-in light socket adapter which is not anticipated, rendered obvious, suggested, or even implied by any of the prior art light sockets, either alone or in any combination thereof.

To attain this, the present invention essentially comprises a push-in light socket adapter for use with a conventional household light bulb socket for facilitating a rapid removal and replacement of a light bulb. The adapter includes a threaded socket body which may be engaged to the household light bulb socket in place of the light bulb. The light bulb may then be inserted directly into the adapter without rotating the bulb. The adapter allows a removal of a burnt-out light bulb by a simple pulling motion which releases the bulb from the socket body. A new bulb may then be easily inserted into the adapter by pushing it into the socket body. The light socket adapter further includes an indicator light operable to indicate both a supply of electrical power to the device and a presence of the light bulb within the socket body.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new push-in light socket adapter apparatus which has many of the advantages of the light sockets mentioned heretofore and many novel features that result in a push-in light socket adapter which is not anticipated, rendered obvious, suggested, or even implied by any of the prior art light sockets, either alone or in any combination thereof.

It is another object of the present invention to provide a new push-in light socket adapter which may be easily and efficiently manufactured and marketed.

It is a further object of the present invention to provide a new push-in light socket adapter which is of a durable and reliable construction.

An even further object of the present invention is to provide a new push-in light socket adapter which is susceptible of a low cost of manufacture with regard to both materials and labor, and which accordingly is then susceptible of low prices of sale to the consuming public, thereby making such push-in light socket adapters economically available to the buying public.

Still yet another object of the present invention is to provide a new push-in light socket adapter which provides in the apparatuses and methods of the prior art some of the advantages thereof, while simultaneously overcoming some of the disadvantages normally associated therewith.

Still another object of the present invention is to provide a new push-in light socket adapter for use with a conventional household light bulb socket for facilitating a rapid removal and replacement of a light bulb.

Yet another object of the present invention is to provide a new push-in light socket adapter which may be engaged to a conventional household light bulb socket in place of a light bulb.

Even still another object of the present invention is to provide a new push-in light socket adapter which includes an indicator light operable to indicate both a supply of electrical power to the adapter and a presence of a light bulb within the adapter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 1.

FIG. 4 is a cross sectional view taken along line 4—4 of FIG. 3.

DESCRIPTION OF THE PREFERRED EMBODIMENT

Figure 1:
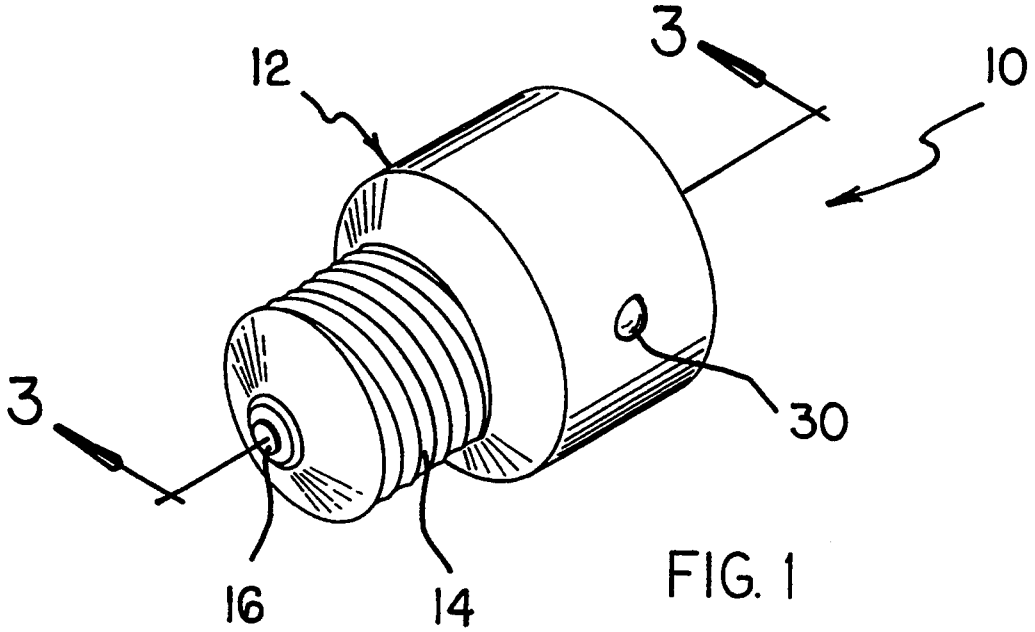
FIG. 1 is a perspective view of a push-in light socket adapter comprising the present invention.

With reference now to the drawings, and in particular to FIGS. 1–6 thereof, a new push-in light socket adapter embodying the principles and concepts of the present invention and generally designated by the reference numeral 10 will be described.

The push-in light socket adapter 10 comprises a socket body 12 having a substantially electrically conductive exterior threaded contact 14 and an exterior center contact 16 which are both adapted to engage portions of a conventional household light bulb socket. The exterior threaded contact 14 and the exterior center contact 16 are operable to provide electrical communication between the household light bulb socket and an interior of the socket body 12. Located on diametrically opposed interior surfaces of the socket body 12 are a pair of interior contacts 18 which are formed of a substantially electrically conductive material and which are positioned in electrical contact with the exterior threaded contact 14. The interior of the socket body 12 further contains an interior center contact 20 which is similarly formed of a substantially electrically conductive material and is in electrical communication with the exterior center contact 16.

Figure 2:
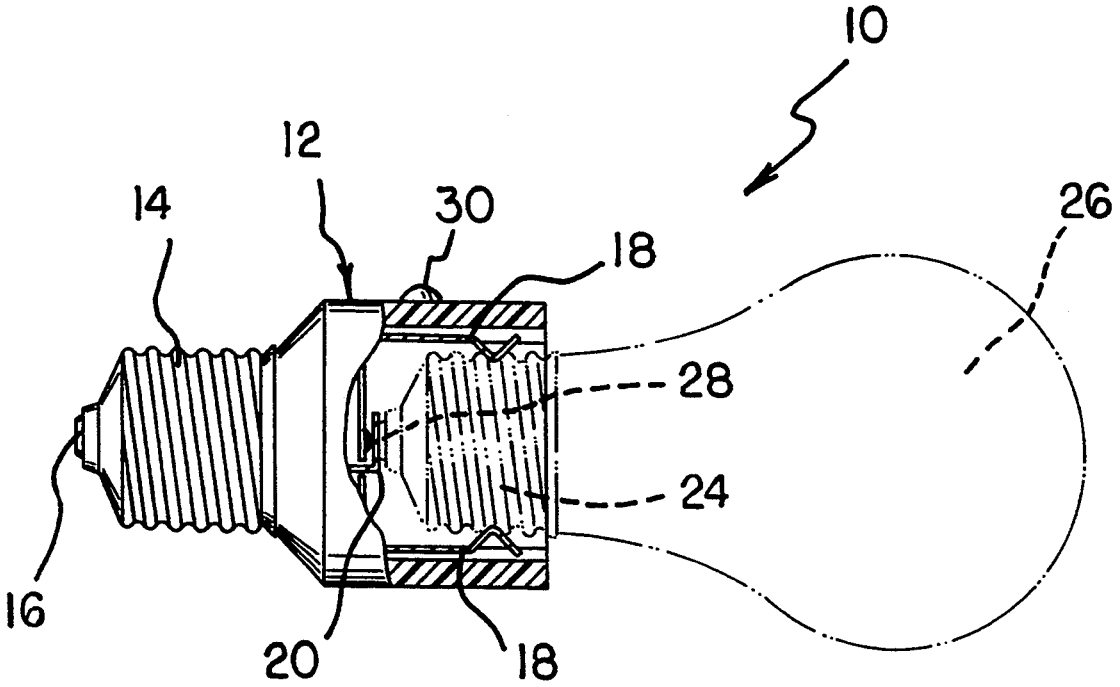
FIG. 2 is a side elevation view, partially in cross section, of the present invention.

The interior contacts 18 each include a raised area 22 operable to frictionally and electrically engage a light bulb threaded contact 24 of a conventional light bulb 26, as best illustrated in FIG. 2, thereby releasably retaining the same within the adapter 10. The interior center contact 20 is operable to provide electrical communication between the exterior center contact 16 of the socket body 12 and a light bulb center contact 28 of the light bulb 26. The raised area 22 of each of the interior contacts 18 is capable of a resilient deformation which allows the light bulb 26 to be inserted into and retained within the socket body 12 without a rotation thereof.

An indicator light 30 is disposed upon an exterior surface of the socket body 12 and will illuminate to indicate both a supply of electrical power to the device 10 and a presence of the light bulb 26 within the socket body. The indicator light 30 is operable to allow a user to distinguish between a burnt-out light bulb and an interrupted supply of electrical power to the light bulb.

In use, the socket body 12 may be threadably engaged to a conventional household light bulb socket in a well understood manner. The light bulb 26 may then be inserted directly into the adapter 10 without a rotation of the light bulb as is typically done for conventional light bulb installations. During normal conditions, both the indicator light 30 and the light bulb 26 will illuminate upon a supply of power to the household light bulb socket. Should the light bulb 26 burn-out, the indicator light 30 will remain lit indicating such a condition. Should the light bulb 26 become disengaged from the interior center contact 20 or should a supply of electrical power to the light socket adapter 10 be interrupted, the indicator light 30 will not illuminate, thereby indicating such a further condition. The indicator light 30 allows a user to easily determine a condition of the light bulb 26 and further allows a user to rapidly remove and replace an inoperative light bulb.

More specifically, it will be noted that the push-in light socket adapter 10 comprises a socket body 12 having a substantially cylindrically shaped socket portion 32 which is integrally or otherwise fixedly secured to a substantially tapered reduced portion 34 of decreasing diametric cross section. The reduced portion 34 is further integrally or otherwise fixedly secured to a plug portion 36 having a shape substantially similar to a light bulb threaded contact 24 of a conventional light bulb 26. Disposed upon an exterior surface of the plug portion 36 is an exterior threaded contact 14 comprising a substantially corrugated metal sheath defining threads around a surface thereof operable to mate with cooperating threads of a conventional household light bulb socket.

The plug portion 36 further includes, in a center area thereof, an exterior center contact 16 made of any substantially electrically conductive material which projects into an unlabeled interior space of the plug portion 36, as best illustrated in FIG. 3. The exterior center contact 16 is operable to engage a cooperating unillustrated interior contact of the conventional household light bulb socket.

A pair of interior contacts 18 are disposed upon diametrically opposed interior surfaces of the socket portion 32 of the socket body 12 and they project down through both the reduced portion 34 and the plug portion 36 to electrically connect with the exterior threaded contact 14 by virtue of their placement between the exterior threaded contact and the plug portion. The interior contacts 18 are secured to the socket body 12 by a plurality of fasteners 38 which engage the same. Each of the interior contacts 18 includes a raised area 22 forming a substantially V-shaped, resiliently deformable area which is operable to fictionally engage the light bulb threaded contact 24 of the light bulb 26 placed within the socket portion 32 of the socket body 12, thereby retaining the same therewithin.

Disposed within the interior of the plug portion 36 is an interior center contact 20 which is electrically connected to the exterior center contact 16 and projects into the socket portion 32 of the socket body 12. The interior center contact 20 includes a center area 40 which extends substantially perpendicular to a longitudinal axis of the socket body 12. The center area 40 is operable to electrically engage a light bulb center contact 28 of the light bulb 26 to provide electrical communication through the interior center contact 20 to the exterior center contact 16, as best illustrated in FIG. 3. An insulator 42 is positioned immediately below the center area 40 of the interior center contact 20 in a spaced relationship relative thereto and includes an unlabeled rectangular aperture which allows the center area to pass therethrough.

The indicator light 30 is disposed upon an exterior surface of the socket portion 32 and comprises an illumination means such as an LED or the like. The indicator light 30 is electrically connected by unillustrated conductors to one of the interior contacts 18 and also to an indicator light contact 44 disposed immediately behind the center area 40 of the interior center contact 20 and upon the insulator 42, as best illustrated in FIG. 3. Because the center area 40 is capable of a slight deformation upon an insertion of the light bulb 26 within the socket body 12, a presence of the light bulb within the socket body will cause the center area to electrically contact the interior light contact 44, thereby energizing the indicator light 30. In this manner, a user may readily ascertain that electrical power is provided to the push-in light socket adapter 10 and that the light bulb 26 has been fully inserted into the socket body 12 to engage both the interior contacts 18 and the interior center contact 20.

Figure 5:
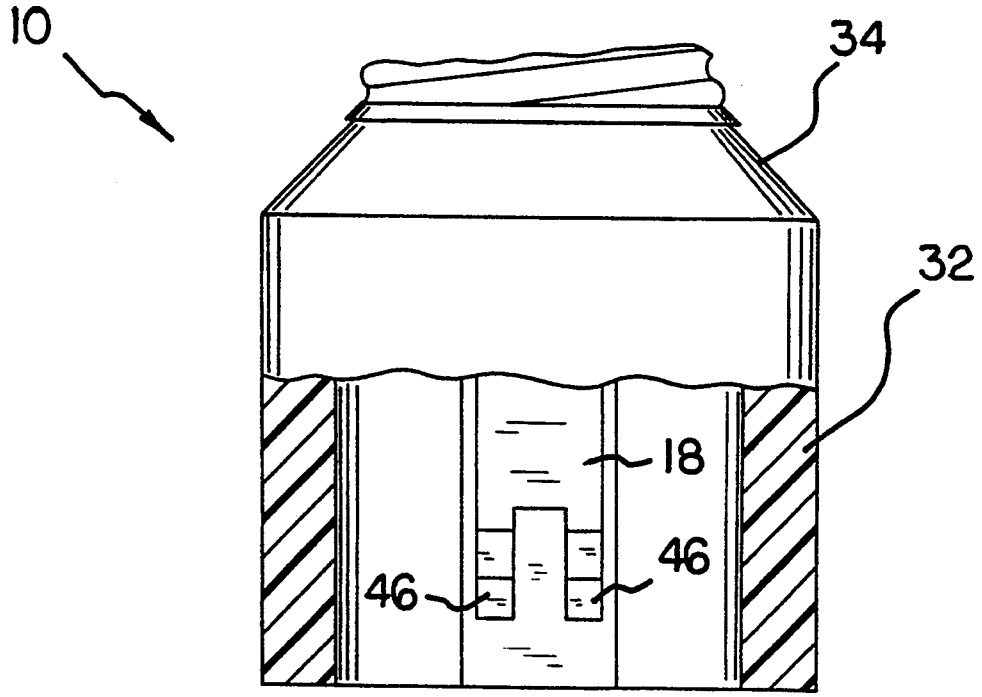
FIG. 5 is an enlarged front elevation view, partially in cross section, of a portion of the present invention.
Figure 6:
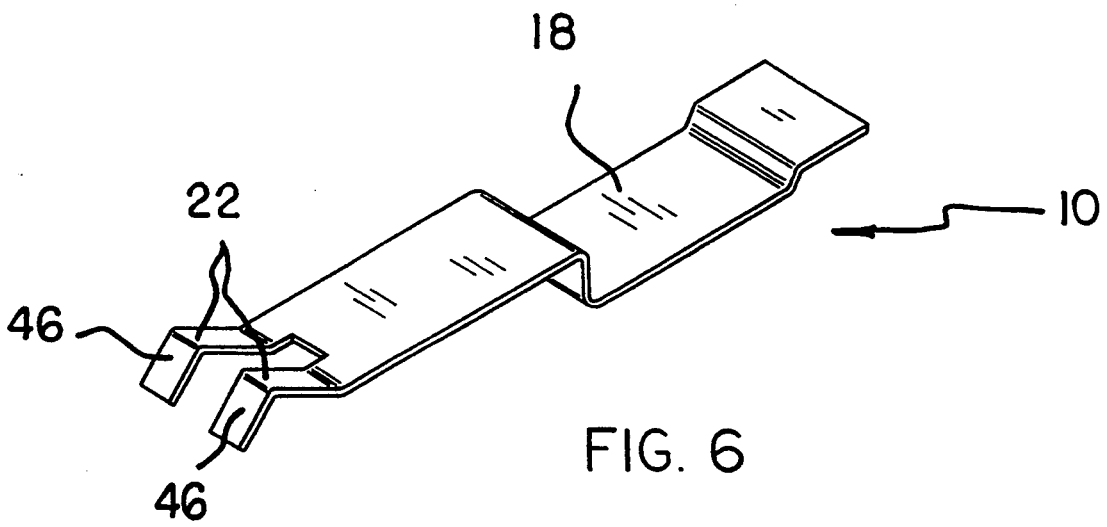
FIG. 6 is a perspective view of an interior contact comprising a portion of the invention.

FIG. 5 details a structural design of each of the interior contacts 18 and it can be seen from this Figure that the interior contacts each include a pair of bifurcated arms 46 which comprise the raised area 22 thereof. The bifurcated arms 46 are operable to allow the interior contacts 18 to conform to a cylindrical shape of the light bulb threaded contact 24, thereby providing better contact therebetween. The preferred embodiment comprises two interior contacts disposed upon diametrically opposed interior surfaces of the socket portion 32 of the socket body 12. However, any number of interior contacts 18 may be disposed upon the interior surface to accomplish a retention of the light bulb threaded contact 24 within the socket body 12, as well as electrical communication therebetween.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A push-in light socket adapter comprising:

a socket body having both a light bulb engaging means for releasably receiving a light bulb and a light socket engaging means for releasably coupling said socket body to a light socket, said light socket engaging means comprising a plug portion adapted to be received within said light socket, said light bulb engaging means comprising a socket portion having a substantially cylindrical shape defining a hollow interior, said socket portion being integrally connected to said plug portion by a reduced portion positioned therebetween;

at least one exterior threaded contact disposed upon an exterior surface of said light socket engaging means;

an exterior center contact disposed upon a longitudinal center of an exterior surface of said light socket engaging means;

an interior center contact in constant electrical communication with said exterior center contact, said interior center contact having a center area thereof and being disposed upon a longitudinally centered interior surface area of said light bulb engaging means and operable to electrically engage a light bulb center contact of said light bulb;

at least one interior contact disposed upon at least one further interior surface area of said light bulb engaging means, said at least one interior contact being in constant electrical communication with said exterior threaded contact and being operable to releasably retain said light bulb within said light bulb engaging means upon a direct, non-rotating insertion thereof, said at least one interior contact further being operable to provide electrical communication between said exterior threaded contact and a light bulb threaded contact of said light bulb;

and, an indicator light positioned upon an exterior surface of said socket body, said indicator light being in electrical communication with both said interior center contact and said at least one interior contact upon an engagement of said light bulb to said light bulb engaging means, wherein said indicator light is in constant electrical communication with said at least one interior contact, and further comprising an indicator light contact positioned behind said center area of said interior center contact, said indicator light being in further electrical communication said indicator light contact such that an insertion of said light bulb into said socket portion will bias said center area of said interior center contact into electrical contact with said indicator light contact.

* * * * *